United States Patent [19]

Freedom

[11] 4,270,247

[45] Jun. 2, 1981

[54] CLASP

[76] Inventor: John Freedom, 17100 S. Harlem Ave., Tinley Park, Ill. 60477

[21] Appl. No.: 25,191

[22] Filed: Mar. 29, 1979

[51] Int. Cl.[3] ..... B65D 77/10; B65D 63/00

[52] U.S. Cl. ..... 24/30.5 R; 24/30.5 P; 24/20 TT; 24/16 PB; 24/115 A; 229/65

[58] Field of Search ..... 24/30.5 R, 30.5 W, 30.5 P, 24/30.5 S, 30.5 T, 30.5 L, 206 A, 115 A, DIG. 28, 255 BS, 20 TT, 16 PB; 229/65

[56] References Cited

U.S. PATENT DOCUMENTS

| | | | |
|---|---|---|---|
| D. 190,787 | 6/1961 | Schneider | 24/30.5 P |
| 222,032 | 11/1879 | Giles et al. | 24/30.5 R |
| 281,663 | 7/1883 | Brobst | 24/30.5 R |
| 324,913 | 8/1885 | Austin et al. | 24/30.5 R |
| 588,848 | 8/1897 | Wightman | 24/30.5 R |
| 862,749 | 8/1907 | McLaughlin | 24/20 TT |
| 896,142 | 8/1908 | Oxley | 24/30.5 R |
| 1,091,288 | 3/1914 | Carlson | 24/30.5 R |
| 1,821,418 | 9/1931 | Brooks | 24/115 A |
| 2,396,906 | 3/1946 | Windson | 24/30.5 S |
| 2,405,912 | 8/1946 | Tinnerman | 24/20 TT |
| 3,473,768 | 10/1969 | Piasecki | 24/16 PB |
| 3,535,746 | 10/1970 | Thomas, Jr. | 24/30.5 T |
| 3,571,861 | 3/1971 | Olson | 24/30.5 P |
| 3,882,573 | 5/1975 | Thomas, Jr. | 24/30.5 T |
| 4,079,484 | 3/1978 | Nakama | 24/16 PB |
| 4,097,967 | 7/1978 | Conner, Jr. | 24/30.5 R |

FOREIGN PATENT DOCUMENTS

| | | | |
|---|---|---|---|
| 168590 | 7/1934 | Switzerland | 229/65 |
| 999929 | 7/1965 | United Kingdom | 24/30.5 R |
| 1206090 | 9/1970 | United Kingdom | 229/65 |

*Primary Examiner*—Victor N. Sakran
*Attorney, Agent, or Firm*—Basil E. Demeur

[57] ABSTRACT

There is disclosed an improved clasp formed by a clasp bar including a pair of clasp arms extending outwardly from a central junction point, each of the clasp arms terminating in an outer end, the opposed outer ends being provided with cooperating lock means such that the clasp bar may be utilized to encircle a substantially flexible article and the lock means manipulated to encircle and lockingly engage the flexible article within the confines formed by the clasp arms and central junction point and the locking means. Various of the embodiments disclose a clasp bar wherein the clasp arms are formed of a resilient material and may be biasingly urged into touching contact in order to permit the lock means to cooperatively engage one another thereby to encircle and lock the flexible article therein.

12 Claims, 16 Drawing Figures

FIG. 1
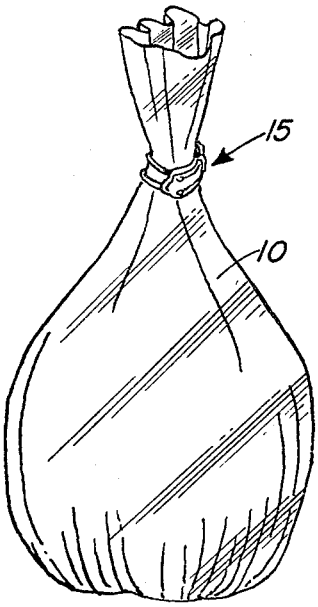
FIG. 2
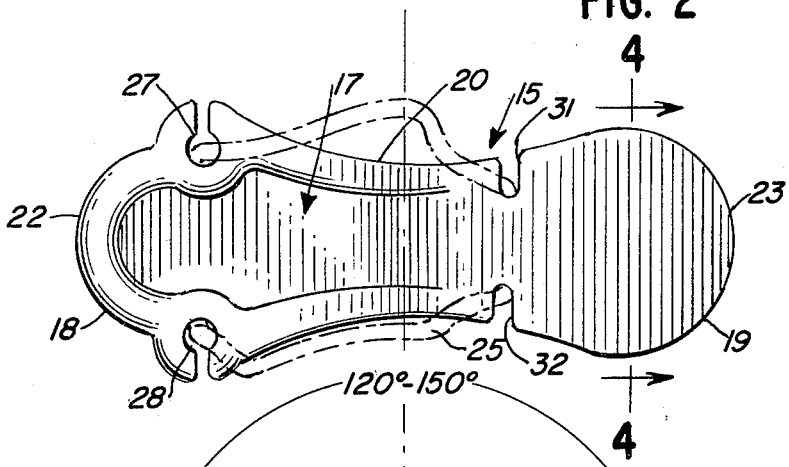
FIG. 3
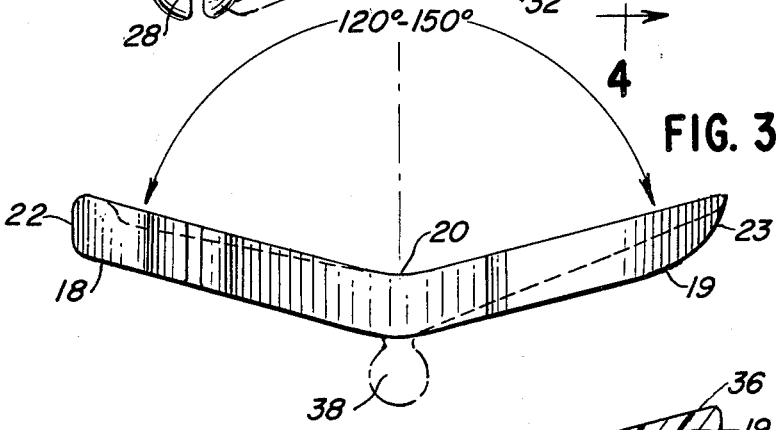
FIG. 4
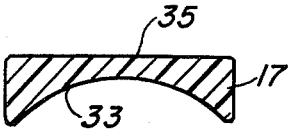
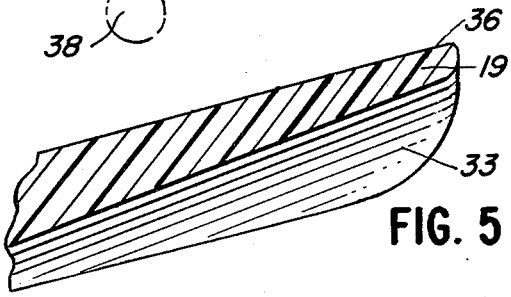
FIG. 5
FIG. 6A
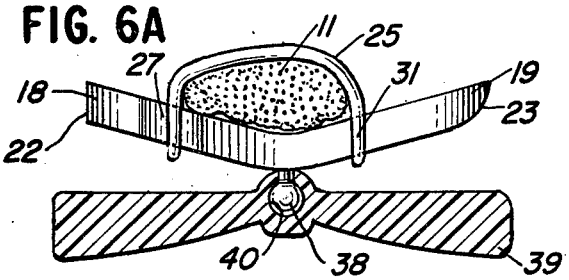
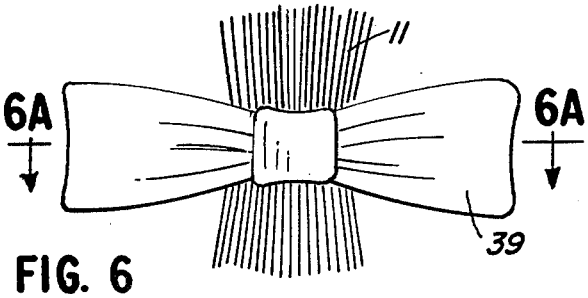
FIG. 6
FIG. 7
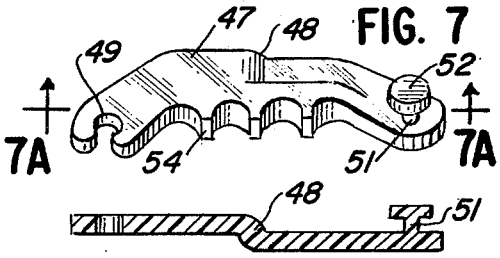
FIG. 7A
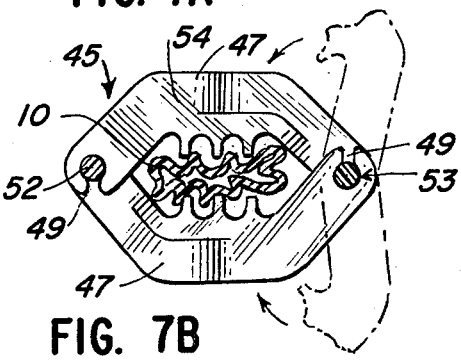
FIG. 7B FIG. 8
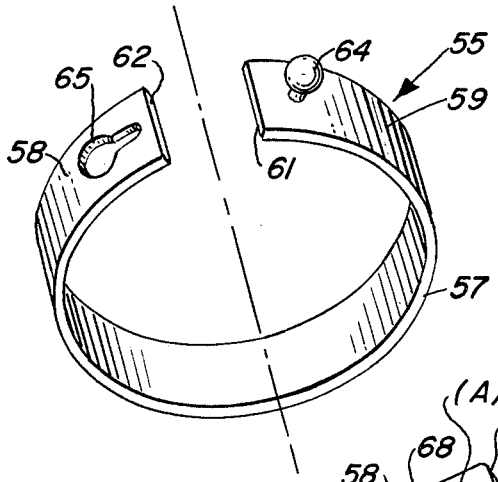
FIG. 8A
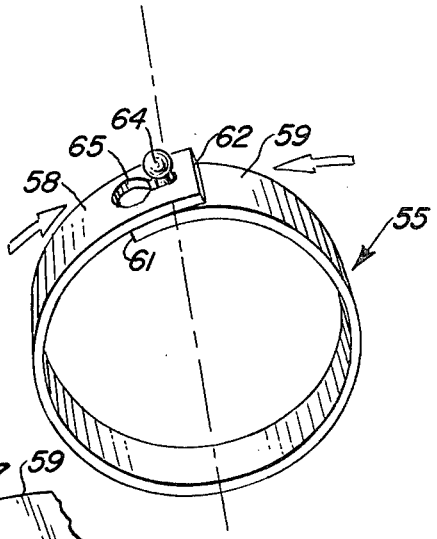
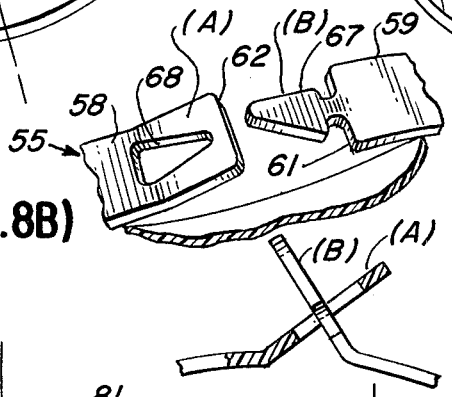
(FIG.8B)
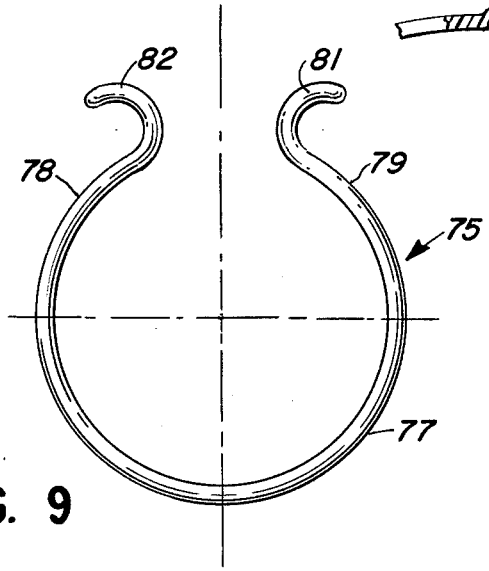
FIG. 9
2B
2B
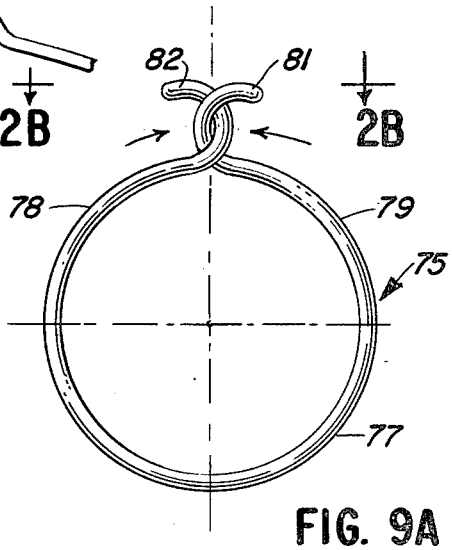
FIG. 9A
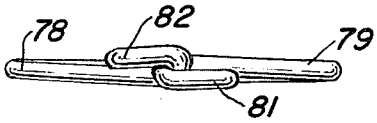
FIG. 9B

CLASP

BACKGROUND OF THE INVENTION

The extensive use of plastic packaging to preserve a variety of articles has become well known and extensive. Perhaps the most prevalent use of flexible plastic packaging relates to the preservation of food products once a food package is opened and the food article is to be retained in a storage facility such as a refrigerator. For example, the extensive use of polyethylene plastic bags for the preservation of open food articles is in extensive use today.

Typically, the plastic bags or other flexible plastic packaging articles have one open end to permit the insertion and removal of the article from the bag. Once an article is inserted within the confines of the bag, the bag is twisted into a closed position, and a clasp fastener of some type is then used to encircle the stem of the bag and fastened. The most common form of the fastener utilized today consists of a wire which is encased in a paper casing, the fastening accomplished by simply manipulating the wire around the stem of the bag, and fastening the ends of the wire by a twisting motion. Another form of a plastic fastener consists of a flat piece of substantially resilient plastic which has a slot cut into one side of the plastic terminating in an open slot area which permits the operator to insert the plastic stem of the bag through the slot and into the open area in a bayonet fastener type arrangement. However, this type of fastener has been found to be less than desirable since the plastic bag cannot be adequately closed and hence, air is permitted to leak into the bag which causes a spoilage of any food product contained therein.

With respect to the wire type fastener, it has been found that with use, the paper or cardboard casing surrounding the wire often wears extensively which then exposes the ends of the wire to the operator. The exposed wire presents a potential threat of injury to the user since the ends of the wire can puncture and penetrate the fingers of the operator during the fastening procedure.

It has been deemed desirable to develop a fastening system especially adapted for fastening relatively flexible articles, such as the stems of plastic bags, and also useful for any other fastening procedure for encircling and retaining a relatively flexible article, which is easy and simple to use, economic to manufacture, and minimizes the possible exposure of injury to the user thereof. It has therefore been deemed desirable to develop a clasp formed of a resilient material, such as a resilient plastic material, which minimizes or eliminates moving parts, and is basically as easy to utilize as the wire type fastener described hereinabove.

OBJECTS AND ADVANTAGES

It is therefore the principal object of the invention to provide an improved clasp which is adapted to encircle and lock about a relatively flexible article which is formed of an economically efficient material, lends itself to ease of use, and otherwise minimizes or entirely eliminates the possibility of injury to the user during the fastening procedure.

In conjunction with the foregoing object, it is the further object of the invention to provide an improved clasp which is formed by a clasp bar having a pair of clasp arms extending arcuately outwardly from a central junction point and wherein each of the clasp arms terminates at an outer end, the clasp arms and central junction point being substantially co-extensive and formed of a reasonably resilient material, each of the outer ends of each of the clasp arms being spaced a distance apart in normal disposition, and including cooperating lock means associated therewith which cooperate to encircle and lockingly retain a relatively flexible article between the clasp arms and the lock means.

In conjunction with the foregoing object, it is a further object to provide an improved clasp of the type described wherein the lock means is formed by a flexible band fixedly secured adjacent to the outer end of one of the clasp arms, and wherein the opposed clasp arm includes a receiving slot for receiving an end of the flexible band such that a relatively flexible article may be encircled and retained between the clasp arms and the flexible band which is stretched across and received in the receiving slot.

Still a further object of the invention is to provide an improved clasp of the type generally described wherein the clasp arms are pivotally secured one to the other at a central pivot point located at the central junction point, and wherein the two clasp arms travel in parallel planes one relative to the other, the outer end of one clasp arm including a lock rod, and the opposed clasp arm including a lock receiving slot, whereby the flexible article may be encircled and retained between the clasp arms as they are pivoted together until the lock rod slides into and fastens in the lock slot provided.

In conjunction with the foregoing object, it is yet a further object to provide an improved clasp of the type described above, wherein each of the clasp arms further includes a serration formed therein such that when the clasp arms are brought together, the relatively flexible article is retained between the serrated clasp arms thereby to securely hold the flexible article in an encircled and locked position.

Still a further object of the invention is to provide an improved clasp of the general type described above, wherein the clasp arms and central junction point are formed as a unitary integral assembly, and wherein the clasp arms are sufficiently resilient to be biasingly urged into touching contact in encircled relationship with respect to the flexible article contained therein, and wherein each of the outer ends of each of the clasp arms includes cooperating lock means to lockingly engage when the clasp arms fully encircle the flexible article.

In conjunction with the foregoing object, it is yet a further object to provide an improved clasp of the type described wherein the lock means is formed by a lock knob fixedly secured along the outer end of one of said clasp arms, and the opposed outer end of the opposing clasp arm includes a lock slot such that when said clasp arms are brought into touching contact, the lock knob may be positioned within the lock slot thereby to lockingly engage the two clasp arms in encircling and locked relationship with regard to the flexible article contained therein.

Still a further object of the invention is to provide an improved clasp of the type generally described, wherein the lock means formed on each of the ends of the two clasp arms consists of a reversely directed curvilinear portion, the opposed curvilinear portion being reversely disposed one relative to the other, such that when the flexible arms are biasingly urged toward one another in encircled relationship about the flexible article, the locking procedure is accomplished by interlocking the two reversely directed curvilinear portions.

In conjunction with the foregoing objects, it is yet a further object to provide an improved clasp of the type generally described, wherein the lock means is formed by a bayonet type extension formed in the outer end of one clasp arm and a bayonet slot formed in the outer end of the opposed clasp arm, such that when the clasp arms are biasingly urged together, the bayonet extension may be inserted in the bayonet slot thereby to achieve a locking engagement about the flexible article contained therein.

SUMMARY OF THE INVENTION

In summary, the present invention provides an improved but simplified clasp intended to permit the encircling locking engagement of the clasp about a flexible article, while at the same time, eliminating any undesirable features of a fastener which could possibly cause injury or damage to the operator thereof. In summary, the present invention provides an improved clasp wherein the clasp is formed by a clasp bar including a pair of clasp arms extending arcuately outwardly from a central junction point, and wherein the clasp arms are provided with cooperating locking means adjacent to the outer ends thereof, such that the clasp arms may be used to encircle a flexible article to be locked therein, and the lock means manipulated to completely encircle the flexible article and lockingly engage as between the outer ends of the two clasp arms.

Further features of the invention pertain to the particular arrangement of the parts and elements whereby the above outlined operating features thereof are obtained. The invention, both as to its organization and method of operation, will best be understood by reference to the following drawings in which:

BRIEF DESCRIPTION OF THE DRAWINGS

FIG. 1 is a perspective view showing a typical flexible container such as a bag, which includes one embodiment of an improved clasp of the present invention lockingly engaging the neck of the container;

FIG. 2 is a front elevation view of one embodiment of a fastener in accordance with the present invention showing a flexible band as the locking means which interlocks between the opposed clasp arms;

FIG. 3 is a top view of still another embodiment of a fastener in accordance with the present invention which further includes a connecting nib intended to accommodate the interconnection of a decorative article thereon;

FIG. 4 is a cross sectional view taken in the direction of the arrows along the line 4—4 of FIG. 2, showing the outer and inner surfaces of the clasp depicted therein;

FIG. 5 is a perspective view, partly broken away, showing the configuration of the outer end of the clasp arm of the fastener as depicted in FIG. 3 of the drawing;

FIG. 6 is a plan view showing a decorative bow attached to a fastener of the present invention as depicted in FIG. 3 of the drawings;

FIG. 6A is a top view, in cross section, showing a fastener of the type shown in FIG. 3 bound to a relatively flexible article such as a lock of hair, and including a decorative bow attached thereto to a connecting nib;

FIG. 7 is a plan view showing yet another embodiment of a fastener in accordance with the present invention wherein the clasp arms are formed as separate entities, but wherein the clasp arms may be joined together to form a pivot point and lockingly engage an article by pivoting into touching contact until the lock means associated with the outer ends may be fastened;

FIG. 7A is a side elevational view, in cross section taken along the line 7A—7A in the direction of the arrows, in FIG. 7;

FIG. 7B is a top plan view showing the manner in which the clasp arms, as depicted in FIGS. 7 and 7A, may be joined together at a common pivot point, and then pivoted into locking engagement by causing the cooperating lock means to interconnect and lock about a relatively flexible article.

FIG. 8 is a perspective view of still another embodiment of an improved clasp of the present invention wherein the lock means are formed by a lock knob extending upwardly from one clasp arm, and a lock slot formed in the opposing clasp arm thereby permitting the clasp arms to be biasingly urged together until the knob and slot interconnect;

FIG. 8A is a perspective view showing the clasp as depicted in FIG. 8 in its locking disposition;

FIG. 8B shows still another embodiment of a clasp in accordance with the present invention wherein one clasp arm includes a bayonet extension, and the opposed clasp arm includes a bayonet slot such that the clasp arms may be biasingly urged into touching contact until the bayonet extension is inserted in the bayonet slot to form a locking engagement;

FIG. 9 is a front view showing still another embodiment of a clasp in accordance with the present invention wherein each of the clasp arms includes a reversely directed curvilinear portion, each of the curvilinear portions being disposed in reverse directions such that the clasp arms may be biasingly urged together and the two curvilinear sections interconnected to form the locking means;

FIG. 9A is a front view of an improved clasp, as depicted in FIG. 9, showing the curvilinear portions in the engaged and locked disposition; and FIG. 9B shows still another variation of the lock means associated with an improved clasp of the type depicted in FIGS. 9 and 9A wherein the curvilinear portions are formed of a sufficiently resilient material whereby the same may be pressed against the clasp arm thereby to positively lock the curvilinear portions into locked and engaged disposition.

DETAILED DESCRIPTION OF THE DRAWINGS

With reference to FIGS. 1 through 3 of the drawings, one embodiment of a proposed improved clasp as contemplated by the present invention is depicted. It will be appreciated that the clasp of the present invention may be utilized in connection with virtually any relatively flexible article, and as shown in FIG. 1 of the drawings, the improved clasp is shown to be used in connection with a flexible bag 10. However, as shown in FIGS. 6 and 6A of the drawings, the clasp of the present invention may similarly be used on a bundle or lock of hair 11 and is intended to indicate that a clasp of the present invention has use beyond merely the enclosure of polyethylene bags.

With reference, once again, to FIGS. 1 through 3 of the drawings, the clasp 15 is shown to be formed by a clasp bar 17 which is, in turn, formed by a pair of clasp arms 18 and 19 respectively which emanate outwardly from a central junction point 20. Each of the clasp arms 18 and 19 respectively terminate at an outer end 22 and 23 respectively. Again as is more clearly shown in FIGS. 1 and 3 of the drawings, the clasp arms 18 and 19 extend outwardly from the central junction point 20 at an angle whereby an obtuse angle is created between the outer ends 22 and 23 respectively of the clasp arms 18 and 19.

The lock means associated with the clasp 15 as depicted in FIG. 2 comprises a flexible band 25 which is shown to have one end thereof fixedly secured to the clasp arm 18 by being retained within a pair of retention apertures 27 and 28 respectively. The opposed clasp arm 19 is provided with a pair of receiving slots 31 and 32 respectively as will be appreciated from a view of FIG. 1 of the drawings, the flexible band 25 may simply be stretched around the flexible neck of the bag 10 until the opposed end of the band 25 can be received in the receiving slots 31 and 32. In this position, the neck of the bag 10 is then securely locked in position and totally encircled by means of the clasp bar 17 and the flexible band 25.

As shown in FIG. 4 of the drawings, the rear surface of the clasp bar 17 has an arcuate configuration as generally depicted at 33, while the front surface of the clasp bar 17 is generally flat as generally shown at 35. The arcuate configuration 33 of the rear of the clasp bar 17 is intended to facilitate the grasping of the clasp 15 since the arcuate configuration 33 provides a convenient grasping surface for the fingers of the operator. This configuration simplifies the fastening procedure of grasping the clasp 15 by means of the fingers of the operator, and with the other hand, manipulating the flexible band 25 to stretch it around the neck of the bag 10 until the opposed end of the band 25 can be inserted and received into the receiving slots 31 and 32 respectively.

As shown in FIG. 5 of the drawings, the outer ends of the clasp arms 18 and 19 have a tapered configuration as generally depicted at 36 mainly to minimize the amount of material necessary to form the clasp 15, and also, to provide some degree of flexibility of the outer ends 22 and 23 of the clasp arms 18 and 19 respectively.

As shown in FIGS. 3, 6 and 6A, the clasp 15 may further be provided with an extension nib 38, and as shown in FIGS. 6 and 6A of the drawings, a decorative element such as a bow 39 may be provided which includes a cooperating nib receiving aperture 40 thereby to lockingly engage with the extension nib 38. Quite apparently, where the clasp 15 is intended to be used to fasten a bundle of hair together, by providing an extension nib 38 which accommodate the interconnection of a bow 39, the presence of the clasp 15 may be totally concealed by the decorative element bow 39. It will therefore be appreciated that the clasp as shown in FIGS. 1 through 6 of the drawings has use beyond simply the enclosure and fastening of a polyethylene bag 10.

In the embodiment depicted in FIGS. 7, 7A and 7B of the drawings, yet another version of a similar type clasp is illustrated. In this embodiment, the clasp is formed from two distinct elements which are identical in construction. The clasp 45 (FIG. 7B) is formed by a pair of clasp arms 47 which, for ease of discussion, will be described only in connection with a single clasp arm. As shown in FIG. 7, the clasp arm 47 is formed as an integral element with a central junction point 48 from which the opposed ends extend radially outwardly. One end of the clasp arm 47 is shown to include a lock slot 49 while the opposed end is shown to include a cooperating lock rod 51, which is capped by a lockhead 52. It will further be noted that the opposed ends of the clasp arm 47 are in parallel planes, due to the curvilinear nature of the central junction point 48.

It will be appreciated from a view of FIG. 7B that the clasp assembly is formed by joining two clasp arms 47 of identical construction together by interconnecting a lock rod 51 at one end of one of the clasp arms 47 with a cooperating lock slot 49 of the opposed end of the other clasp arm 47, thereby to form a pivot point as generally shown at 53 (FIG. 7B).

An article such as a flexible bag 10 may be fastened by urging the opposed ends of each of the clasp arms 47 together until the opposed lock rod 51 and lock slot 49 in the opposed ends of the clasp arms 47 may be engaged. It will also be appreciated from a view of FIGS. 7 and 7A that each and every clasp arm 47 is identical to each and every other clasp arm 47 such that a clasp assembly may be constructed from any two clasp arm elements 47. Hence, if the operator simply retains a container having a number of such clasp arms 47 therein, a clasp assembly may be quickly formed which is simple to use, and eliminates any wires or other extraneous pieces which could cause injury to the user.

It will also be appreciated that each of the clasp arms 47 may include serrations 54 which function to more securely enclose the bag 10 which is encircled by the clasp assembly. It will also be appreciated that the clasp assembly as contemplated in FIGS. 7 throgh 7B may also be formed by having a permanent pivot point 53 such that the clasp assembly would come as a completed article and the operator need not first fasten one of the lock rods 51 on one clasp arm 47 to a corresponding lock slot 49 on another clasp arm 47 as a preliminary step to accomplishing the fastening procedure.

As shown in FIGS. 8 and 8A of the drawings, still another version of a clasp in keeping with the present invention is illustrated. As shown in FIG. 8, there is provided a clasp 55, which is in the form of a ring 57 which, in effect, provides a pair of clasp arms 58 and 59 respectively terminating at outer ends 61 and 62 respectively. One of the clasp arms 59 is shown to include a lock knob 64 which extends upwardly from the outer surface of the arm 59, while the opposed clasp arm 58 is shown to include a lock slot 65. As will be appreciate from a view of FIG. 8A of the drawings, the clasp 55 functions by placing the clasp 55 in encircling position around the neck of the bag 10 or other article as desired, and biasingly urging the clasp arms 58 and 59 into touching and overriding contact. The lock knob 64 is then inserted into the lock slot 65 and the clasp arms 58 and 59 released. The natural resiliancy of the material from which the clasp 55 is formed will cause the clasp arms 58 and 59 to ride apart until the lock knob 64 slides into the locking portion of slot 65. It will again then be appreciated that dangerous elements such as wires and the like are eliminated by this construction, while at the same time, there is preserved simplicity of construction and obvious ease of manipulation is achieved.

It will also be appreciated that in order to function within the parameters of the invention, the clasp 55 must be formed of a reasonably resilient plastic material to insure that the clasp arms 58 and 59 have a natural biasing resilience in order to achieve the fastening procedure. It is contemplated that plastic such as polyethylene, polypropylene or various other similar resin materials may be utilized. Such materials are commonly known, and are not intended to form a part of the present invention.

As depicted in FIG. 8B of the drawings, a variation of the embodiment depicted in FIGS. 8 and 8A is illustrated. It will be observed that in this embodiment, the clasp 55 may be provided with a clasp arm 59 which includes a bayonet-type extension 67 and a bayonet slot 68. The bayonet extension 67 is positioned at the outer end 61 of the clasp arm 59, while the bayonet slot 68 is positioned adjacent to the outer end 62 of clasp arm 58. Once again, the fastening is accomplished by biasingly urging the clasp arms 58 and 59 into touching contact, until the bayonet extension 67 may be inserted within the widened portion of bayonet slot 68, and the natural biasing resilience of the material of which the clasp 55 is formed will cause the bayonet extension 67 to ride into the narrowed portion of the bayonet slot 68 to lockingly engage the arms 58 and 59 together in encircled disposition about the article to be enclosed.

In FIGS. 9 and 9A of the drawings, still another embodiment of a proposed clasp in accordance with the present invention is illustrated. As shown therein, there is provided a clasp 75 which, again, is in the form of a ring 77 which in effect provides a pair of clasp arms 78 and 79 respectively. The entire ring 77 is formed as an integral piece, and hence, it is economic to manufacture and relatively slight in cost. As shown in FIG. 9, the outer ends of the clasp arms 78 and 79 are each provided with a reversely directed curvilinear portion 81 and 82 respectively and arranged such that each curvilinear portion is reversely directed with respect to each other. It will be appreciated that the article to be enclosed and fastened is encircled by the ring 77, and the operator may then accomplish the fastening by simply biasingly urging the two clasp arms together until the two curvilinear portions 81 and 82 are engaged as shown in FIG. 9A.

Again, it is contemplated that the clasp 75 will be formed of a resilient plastic material so that the material has a natural biasing tendency when the operator releases the two arms incident to the fastening procedure. Indeed, it is contemplated that as shown in FIGS. 8 and 9 of the drawings, the clasp 55 and the clasp 75, when formed by a molding operation or similar type operation, will have a configuration as depicted in its natural disposition. The locking and fastening procedure is accomplished due to the fact that the material will have a natural tendency to biasingly urge itself apart into the natural position as shown in FIGS. 8 and 9, which therefore has the effect of insuring that the fasteners or lock means will stay in the locked position as shown in FIGS. 8A and 9A respectively. This feature simplifies both the fastening as well as the unfastening operation for the operator and lends ease of operation while still achieving an efficient locking engagement of the article to be encircled and locked.

As shown in FIG. 9B, the clasp 75 as depicted in FIGS. 9 and 9A may be further modified by having the outer ends of the arms 78 and 79 formed of a malleable material such that the curvilinear portions 81 and 82 may be pressed into a secure locking engagement. For example, the ring 77 may be formed of a plastic material, but having a wire running throughout the interior portion of the ring. When the curvilinear portions 81 and 82 are pressed downwardly, due to the malleability of various types of wire, the curvilinear portions 81 and 82 can be pressed against the clasp arm 78 and 79 to achieve a positive lock. In order to unlock or unfasten the clasp 75, the operator need only pull the curvilinear portions 81 and 82 apart thereby to relieve the lock and permit the unfastening of the ring 77.

It will be appreciated from the above description that the present invention provides a simplified and yet positive fastening device for use in conjunction with any substantially flexible article to be banded together. It is contemplated that the fastener of the present invention may be utilized in connection with plastic bags, strands of hair, or any other similar article wherein the intention is to band together the article and keep the same fastened together. The clasp of the present invention, in all of its embodiments, is economic in terms of manufacture, easy to utilize and avoids the potential of injury to the user thereof since elements such as exposed wires and the like are totally eliminated. In addition, it will be appreciated that the clasp of the present invention provides a positive and tight fitting locking device for such flexible articles, while yet presenting an extremely simplified fastening procedure.

While there has been described what is at present considered to be the preferred embodiments of the invention, further modifications may be made within the true spirit and scope of the present invention, and it is intended to cover in the appended claims all such further modifications and embodiments.

I claim:

1. An improved clasp adapted to encircle and lock about a relatively flexible article comprising in combination, a clasp bar having a pair of clasp arms extending arcuately outwardly from a central junction point and each of said clasps arms terminating in an outer end thereof, said clasp arms and central junction point being substantially co-extensive and formed of a reasonably resilient material, said outer ends of said clasp arms being spaced a distance apart in the normal disposition thereof, and each of said outer ends of said clasp arms provided with cooperating lock means which cooperate to encircle and lockingly retain a flexible article between said clasp arms and said lock means, said clasp bar positioned adjacent to a relatively flexible article at said central junction point and said lock means manipulated to encircle the flexible article and lockingly engage the same between said pair of clasp arms.

2. The improved clasp as set forth in claim 1 above, wherein said lock means comprises a flexible band having one end thereof fixedly secured adjacent said outer end of one of said clasp arms, and said outer end of said opposed clasp arm provided with receiving means for lockingly receiving an opposing end of said flexible band whereby a flexible article may be encircled and lockingly engaged when said flexible band is engaged between said outer ends of said opposed clasp arms.

3. The improved clasp as set forth in claim 2 above, wherein said receiving means formed on said opposed clasp arm comprises at least one slot formed in said clasp arm, said slot being adapted to disengageably receive an opposed end of said flexible band.

4. The improved clasp as set forth in claim 1 above, wherein said clasp bar, including said clasp arms and central junction point are formed as an integral one-piece assembly.

5. The improved clasp as set forth in claim 1 above, wherein said central junction point comprises a pivot point, and said clasp arms are pivotally mounted at said pivot point thereby to be pivotally movable relative to one another.

6. The improved clasp as set forth in claim 5 above, wherein said lock means comprises a lock slot formed along said outer end of one of said clasp arms, and a lock rod formed along said outer end of said opposed clasp arm, said lock rod being disengageably engageable within the confines of said lock slot when said opposed clasp are pivotally moved together such that the opposed ends of said opposed clasp arms are brought into touching contact.

7. The improved clasp as set forth in claim 6 above, wherein said one of said clasp arms moves in a plane parallel to the plane formed by said opposing clasp arm, and wherein said lock rod formed along the outer end of said opposed clasp arms extends outwardly therefrom, whereby said lock slot on said opposed clasp arm may become disengageably engaged with said lock rod when said clasp arms are pivotally moved into touching contact.

8. The improved clasp as set forth in claim 7 above, wherein each of said clasp arms is provided with an inner surface, each of said inner surfaces of each of said clasp arms being provided with serrations, such that when said clasp arms are brought into touching contact, the flexible article encircled by said clasp arms may be held in biting engagement between said serrations.

9. The improved clasp as set forth in claim 1 above, wherein said clasp arms are formed integrally with said central junction point, and said clasp arms are substantially resilient and may be biasingly urged into touching contact one with the other, each of said clasp arms including cooperating lock means, whereby said clasp arms may be biasingly urged toward one another and said lock means engaged thereby to encircle a flexible article and lockingly engage the same.

10. The improved clasp as set forth in claim 9 above, wherein said outer end of one of said clasp arms includes a lock knob extending a short distance upwardly therefrom, and said opposed end of said opposed clasp arm includes a lock slot, said clasp arms being of sufficiently resilient to permit the biasing movement of said clasp arms toward one another until said lock knob may be inserted in said lock slot thereby to lockingly engage said clasp arms in encircling locking engagement about the flexible article contained therein.

11. The improved clasp as set forth in claim 9 above, wherein said outer end of one of said clasp arms includes a reversely directed curvilinear portion, and said opposed end of said opposed clasp arm similarly include a reversely disposed curvilinear portion, said opposed curvilinear portions being arranged in reversely opposed directions such that said clasp arms may be brought into touching contact until said opposed reversely directed curvilinear portions may be engaged to form a locking engagement about a flexible article contained therein.

12. The improved clasp as set forth in claim 1 above, wherein said outer end of one of said clasp arms include a bayonet extension extending outwardly therefrom, and said outer end of said opposed clasp arm includes a bayonet slot formed therein, such that when said clasp arms are biasingly urged toward one another, said bayonet extension may be inserted in said bayonet slot thereby to lockingly engage said clasp arms in encircling and engaging disposition about a flexible article contained therein.

* * * * *